United States Patent [19]

McGuire et al.

[11] Patent Number: 4,793,236

[45] Date of Patent: Dec. 27, 1988

[54] SELF-ALIGNING NECK JOINT

[75] Inventors: Michael D. McGuire, 9510 West Hierba, Agua Dulce, Calif. 91350; Stephen J. Boulanger, La Habra, Calif.

[73] Assignees: Albert J. Carness, Chatsworth; Michael D. McGuire, Northridge, both of Calif. ; part interest to each

[21] Appl. No.: 65,897

[22] Filed: Jun. 24, 1987

[51] Int. Cl.[4] ..... G10D 1/08

[52] U.S. Cl. ..... 84/293; 84/267

[58] Field of Search ..... 84/267, 291, 293

[56] References Cited

U.S. PATENT DOCUMENTS

| | | | |
|---|---|---|---|
| 463,953 | 11/1891 | Middlebrooke | 84/293 |
| 602,695 | 4/1898 | Casolin | 84/293 |
| 1,402,876 | 1/1922 | McHugh et al. | 84/293 |
| 2,497,116 | 2/1950 | Dopyera | 84/293 |
| 3,678,795 | 7/1972 | Fullerton | 84/293 |
| 4,027,570 | 6/1977 | Rendell et al. | 84/293 |
| 4,191,085 | 3/1980 | Litwin | 84/293 |
| 4,638,708 | 1/1987 | Kamal | 84/293 |

*Primary Examiner*—Lawrence R. Franklin

*Attorney, Agent, or Firm*—Lyon & Lyon

[57] ABSTRACT

A self-aligning neck joint for releasably securing the neck of an electric guitar to the guitar body and maintaining the neck in fixed proper alignment with the body. The neck joint includes a first bracket secured in a channel in the underside of the upper end of the neck and a second bracket secured in a neck pocket in the guitar body such that upon securing the brackets together the neck is secured to and fixed in proper alignment with the guitar body. The brackets each define a pair of rows of interlocking undercut teeth with one of the rows of teeth on the second bracket being moveable in a transverse direction for selective engagement and disengagement with the mating teeth on the first bracket to allow the brackets to be moved out of engagement and the neck separated from the guitar body. A moveable screw driven wedge is provided on the second bracket to urge the moveable teeth thereon outwardly into fixed engagement with the mating teeth on the first bracket and thereby tightly lock the neck to the body of the guitar in proper alignment.

4 Claims, 2 Drawing Sheets

SELF-ALIGNING NECK JOINT

BACKGROUND OF THE INVENTION

The neck of an electric guitar is typically secured to guitar body by means of four wood screws which extend from the back of the guitar body into the upper end of the neck of the guitar. Such an attachment not only lacks adequate strength for the rough treatment such instruments often receive, but creates tuning problems as a result of the neck frequently becoming misaligned or shifting slightly with respect to the guitar body. Even relatively slight changes in alignment of the neck with respect to the guitar body will alter the tone of the instrument. This problem often become so severe that the strings come off the fingerbroad and the instrument can not be played. In addition, when the joint between the neck and the guitar body loosens, the instrument loses sustain, i.e., the notes will not ring for as long a time. This results from the damping of the strings vibration created by the loose joint.

The present configuration of neck joints generally employed in electric guitars also renders the guitars more difficult to play in the higher registers due to the player's hand abutting the heel of the guitar body under the upper of the neck. In an attempt to provide adequate strength to the joint between the neck add the guitar body, this heel through which the securement screws pass is typically made about one inch thick thereby creating an immovable obstacle for the players hand when playing higher up on the neck.

In view of these problems resulting from configuration and construction of electrical guitars, it would be highly desireable to provide an improved means of securement for joining the neck to the guitar body. Such a joint should provide secure and positive alignment to eliminate reoccurring tuning problems, increase sustain and additionally strengthen the juncture between the neck and body while allowing the thickness of the guitar heel to be reduced. The self-aligning neck joint disclosed and claimed herein provides such a securement.

SUMMARY OF THE INVENTION

Briefly, the present invention comprises a self-aligning neck joint for releasably securing the neck of an electric guitar to the guitar body and maintaining the neck in fixed proper alignment with the body. The joint includes a pair of mating brackets carried by the upper end of the neck and the heel portion of the guitar body. Each of the brackets is provided with two rows of laterally projecting undercut teeth adapted to abut and mate with the corresponding teeth on the other bracket. One of the row of teeth are moveable in a transverse direction to allow selective engagement and disengagement of the mating teeth and separation and securement of the neck and the guitar body. A moveable wedge is provided to selectively urge the moveable teeth outwardly into fixed engagement with the mating teeth on the other bracket whereupon the securely engaged teeth maintain the brackets in tight securement and the neck in fixed proper alignment with the guitar body.

It is the principle object of the present invention to provide a self-aligning neck joint for rigidly securing the neck of an electric guitar to the guitar body and maintain the neck in proper alignment with the guitar body.

It is another object of the present invention to provide a neck joint for securing the neck of an electric guitar to the guitar body which provides improved strength characteristics over the neck joint heretofore in use.

It is yet another object of the present invention to provide a neck joint for securing the neck of an electric guitar to the guitar body which allows the neck to be readily removed from the guitar body and resecured in proper alignment with the guitar body without the need for additional adjustment.

It is a further object of the present invention to provide a neck joint for securing the neck of an electric guitar to the guitar body which allows the thickness of the heel portion of the guitar body to be reduced in thickness while continuing to provide adequate securement strength to facilitate playing the guitar in the higher registers.

These and other objects and advantages of the present invention will become readily apparent from the following detailed description taken in conjunction with the accompanying drawings.

IN THE DRAWINGS

DESCRIPTION OF THE PREFERRED EMBODIMENT

Figure 1:
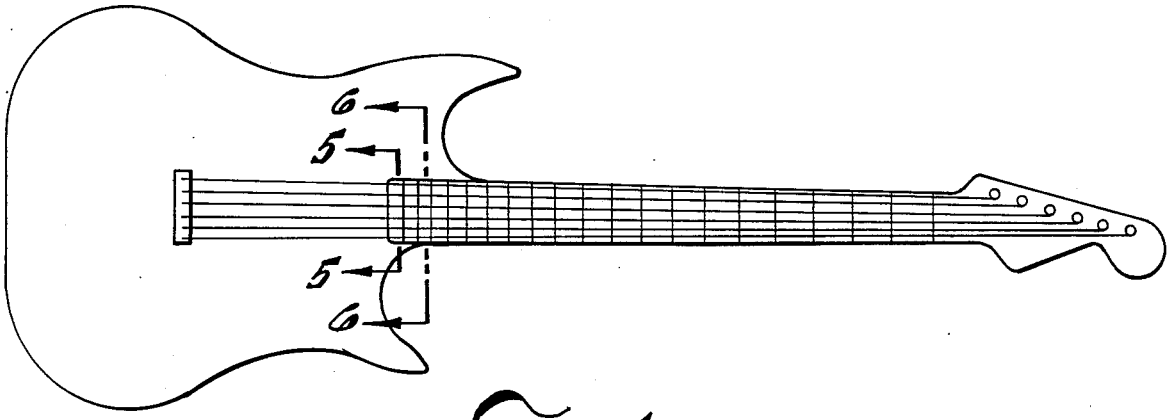
FIG. 1 is a top view of an electric guitar embodying the neck joint of the present invention.
Figure 2:
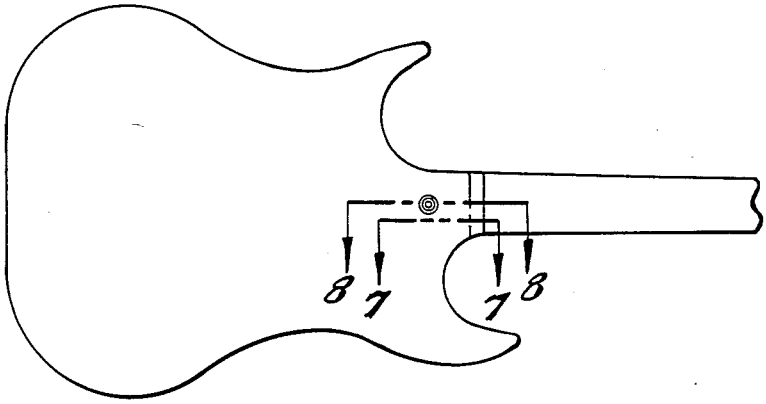
FIG. 2 is a bottom view of an electric guitar embodying the neck joint of the present invention.

Referring now in detail to the drawings, FIGS. 1 and 2 illustrate an electric guitar 10 embodying the self-aligning neck joint 12. The guitar 10 comprises a body portion 14 and a neck 16. The strings 18 extend between the bridge 20 on the guitar body 14 and the tuning pegs 22 rotatably mounted on the head stock 24 at the extended end of neck 16.

Figure 3:
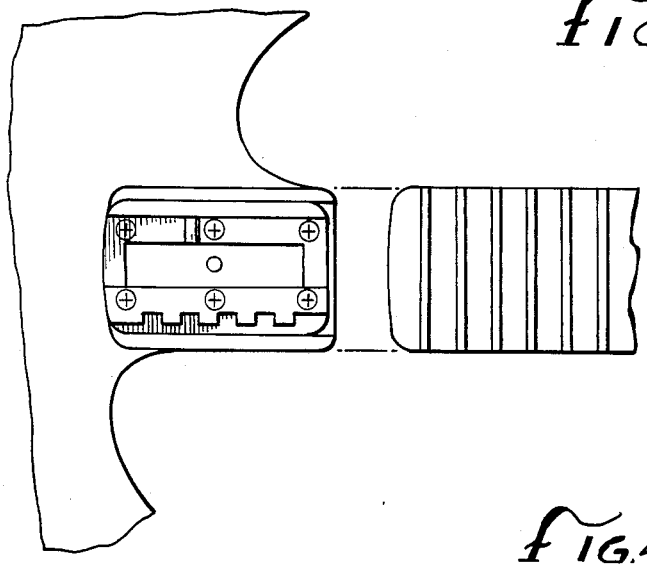
FIG. 3 is an enlarged partial top view of an electric guitar embodying the neck joint of the present invention wherein the neck has been separated from the body illustrating a portion of the neck joint carried by the guitar body.
Figure 4:
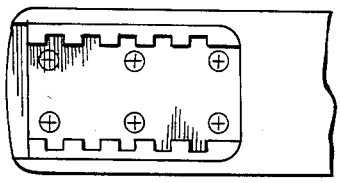
FIG. 4 is a partial bottom view of the guitar neck illustrating the portion of the neck joint secured thereto.

The self-aligning neck joint 12 is comprised of pair of interlocking brackets 26 and 28 with bracket 26 being rigidly affixed to the neck 16 and bracket 28 being similarly secured to the guitar body portion 14 as shown in FIGS. 3 and 4.

Figure 5:
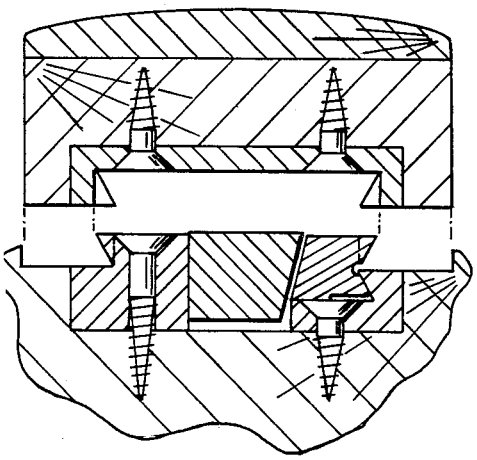
FIG. 5 is a sectional view taken along lines 5—5 of FIG. 1.
Figure 6:
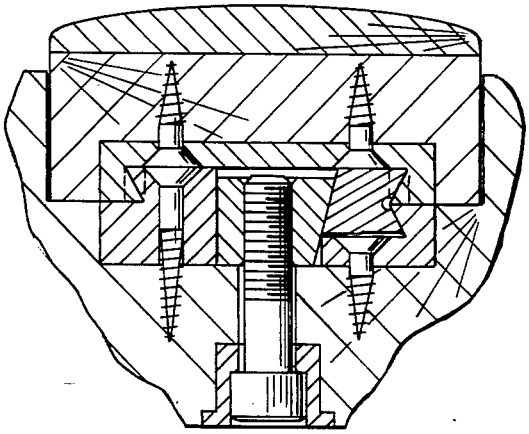
FIG. 6 is a sectional view taken along lines 6—6 of FIG. 1.

Bracket 26, as seen in FIGS. 4–6 is carried by the neck 16 in a recess 32 formed in the underside thereof. Bracket 26 is held in placed by a plurality of spaced wood screws 34, preferably six, which extend through the base portion 36 of the bracket into the neck 16 and terminate below the fingerboard 38 on the upper surface of the neck. Bracket 26 additionally defines two rows of equally spaced lateral tooth members 40 extending inwardly from the upstanding vertical lateral sidewalls 42. Each tooth 40 is undercut so as to define an abutment surface 41 which defines an angle of about sixty degrees with respect to the vertical. Recess 32 in neck 16 is sized such that the exterior lateral walls 44 abut the surfaces 46 of the bracket sidewalls 42. Such configuration in combination with the wood screws prevent any relative movement between bracket 26 and neck 16. To facilitate attachment of bracket 26 to bracket 28 the spacings 43 between teeth 40 are about 0.2–0.3 in. greater width than the tooth members.

As seen in FIG. 3, bracket 28 is also of a rectangular configuration and is carried by the guitar body 14 in a correspondingly configured recess or neck pocket 30. Bracket 28 comprises integrally constructed lateral side portions 50 and 52 and spanning web portions 54 and 56 disposed about a central rectangular opening 58. Side portion 50 defines a lateral side rail 60 spaced from opening 58 by flat horizontal surface 62. Surface 62 is contiguous with and lies in the same horizontal plane as the upper surface of web portions 54 and 56. Side rail 60 is undercut along its length so as to define an abutment surface 63 which is inclined at an angle of about sixty degrees.

The opposite lateral side portion 52 of bracket 28 defines an extended vertical interior side wall 64, flat horizontal upper surface 66, and a vertical recessed exterior side wall 68 terminating in a flat horizontal surface 70. A plurality of spaced tooth members 72 project outwardly from the exterior side wall 68 over a portion of horizontal surface 70. Tooth members 72 are also undercut so as to define angles of about sixty degrees with respect to the vertical and thereby mate with the aligned row of tooth members 40 on bracket 26 as will be later described. A plurality of spaced wood screws 74 extend through flat horizontal surface 62 and through the upper surface 66 in the lateral side portions of bracket 28 and into the guitar body to secure the bracket 28 firmly in place within the neck pocket 30 on the guitar body 14.

Bracket 28 also includes a removable bar or register 76 defining a correspondingly configured and spaced plurality of undercut outwardly projecting tooth members 78. Register 76 is disposed on the flat horizontal surface 62 of bracket 28 adjacent side rail 60 and defines a flat horizontal lower surface 80 adapted to rest on and abut surface 62. The register has an outer lower side wall 82 inclined inwardly at sixty degrees so as to mate with the undercut surface 63 on side rail 60 and terminating in a longitudinally disposed recess 84 extending between the upper edge of side wall 82 and the lower edge tooth members 78. The upper surface 86 of register 76 is horizontal and the inner side wall 88 is inclined downwardly and outwardly so as to define an angle of about fifteen degrees with respect to the vertical.

To properly position register 76 on surface 2 of bracket 28 such that the tooth members 78 thereon are in alignment with the oppositely projecting tooth members 72 on bracket 28, an indexing means is provided. The means shown in FIG. 7 comprises a raised ridge 90 disposed on surface 62 and a correspondingly configured receiving slot 92 is provided in the lower surface 80 of the register 76. The ridge and slot are positioned such that when the register is placed on surface 62 with the ridge 90 disposed within the slot 92, register 76 is in proper alignment on surface 62. Other indexing means such as a ball bearing and detent could be employed for this purpose.

An integrally formed wedge lock member 94 defining flat horizontal upper and lower surfaces 96 and 98, a vertical longitudinal side wall 100 and a tapered longitudinal side wall 102 is disposed between the vertical interior side wall 64 of bracket 28 and the inner side wall 88 of the register 76 as seen in FIGS. 5 and 6. A threaded aperture 104 extends vertically through the wedge lock member 94 in axial alignment with aperture 106 extending through the lower surface 108 of the neck pocket. A metal anchor insert 110 is preferably rigidly affixed in the guitar body about aperture 108 and a machine screw 112 extends therethrough and into threaded engagement with wedge lock member 94.

As a result of the aforesaid configuration, by positioning the neck of the guitar on the body portion such that tooth members 40 on bracket 26 are aligned with the spaces between the tooth members 72 and 78 on the lateral side portion 52 and register 76 and conversely tooth members 72 and 78 are aligned with the spaces between tooth members 40, the neck can be slid toward the guitar body into proper position as the tooth members 40 on the neck can pass under the tooth members 72 and 78 on bracket 28 due to their undercut configurations. In proper position, tooth members 40 are each disposed under one of either tooth members 72 and 78 with the inclined abutment surfaces in parallel disposition.

With the parts in proper alignment rotation of machine screw 112 draws the wedge lock member 94 downwardly and outwardly toward the lower surface 108 of the neck pocket 30. The inclined mating surfaces 102 and 88 on the wedge lock member 94 and register 76 thus urge the register outwardly such that the incline surface 82 on register 76 is urged tightly against mating surface 63 on rail 60, and the inclined surfaces on tooth members 78 on the register are urged against abutment surfaces 41 on tooth members 40, which in turn presses the inclined surfaces on tooth members 72 on bracket 28 against the inclined abutment surfaces 41 on the other row of tooth members 40 on bracket 26. The tight abutting securement of these mating tooth surfaces tightly secures bracket 26 to bracket 28 and the neck 16 to the body portion 14 of the guitar. This tight interlock between the teeth also provides a secure and precise alignment of the brackets and thus of the neck and body portion of the guitar. To provide such securement and precise alignment, the component parts are preferably constructed of metal so as to avoid deformation. Further, as indicated with respect to tooth members 42 the spacing between each of the tooth members is about 0.2–0.3 in. greater than the width of the teeth. Such sizing allows the bracket 26 to be readily positioned for securement without compromising the securement.

To remove the neck from the body portion of the guitar it is merely necessary to loosen the machine screw 112 which relieves the pressure exerted on the register 76 by the wedge lock member 94 and thus allows the neck to be pulled from the guitar body as the bracket 28 can be slide longitudinally along bracket 28 due to the undercut configuration of the mating teeth.

Figure 7:
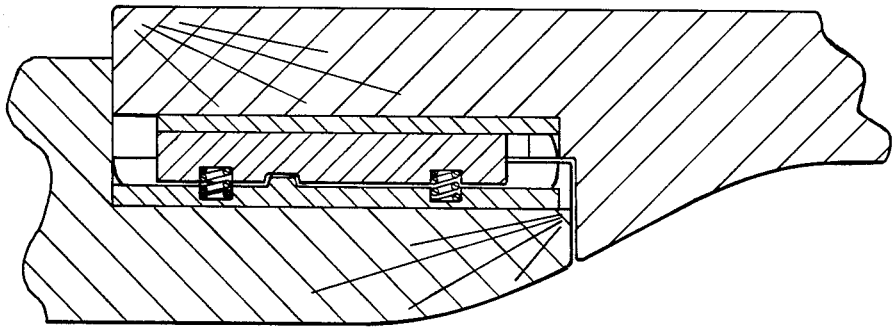
FIG. 7 is a sectional view taken along lines 7—7 of FIG. 2.
Figure 8:
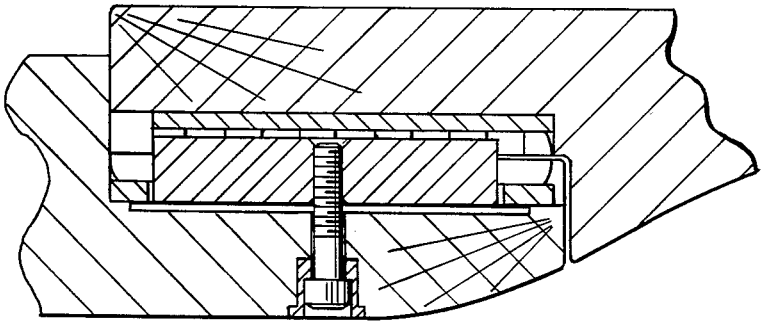
FIG. 8 is a sectional view taken along lines 8—8 of FIG. 2.
Figure 1:
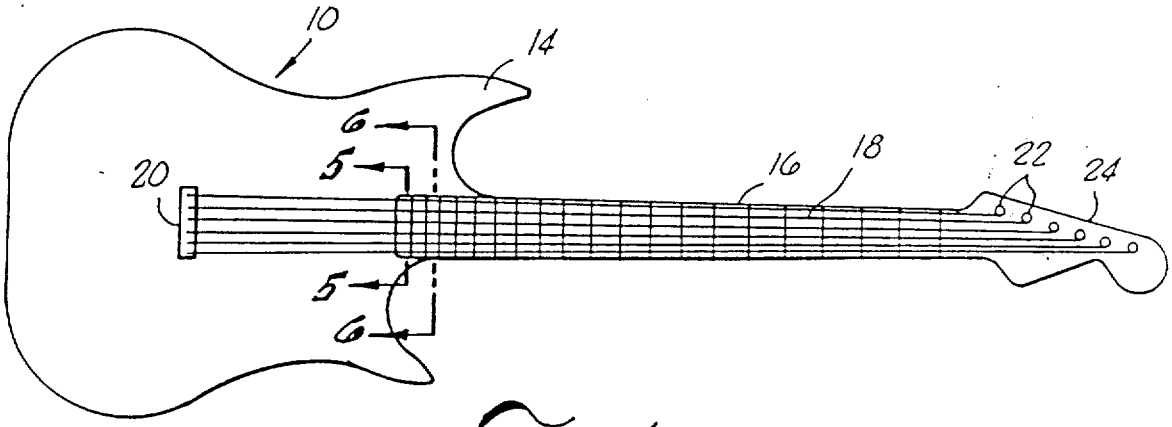
Figure 2:
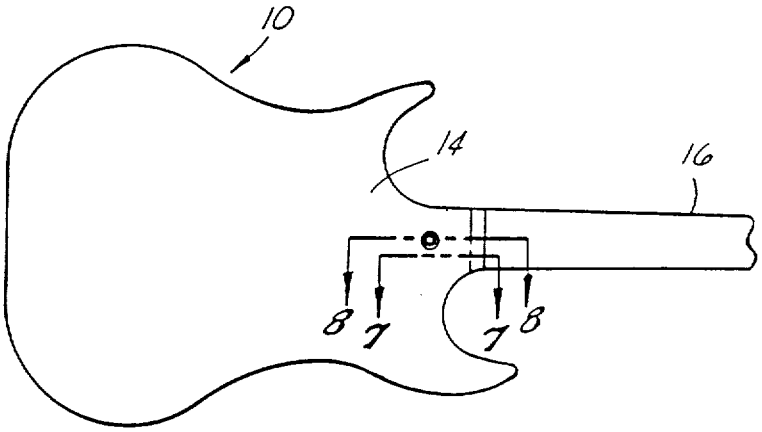
Figure 3:
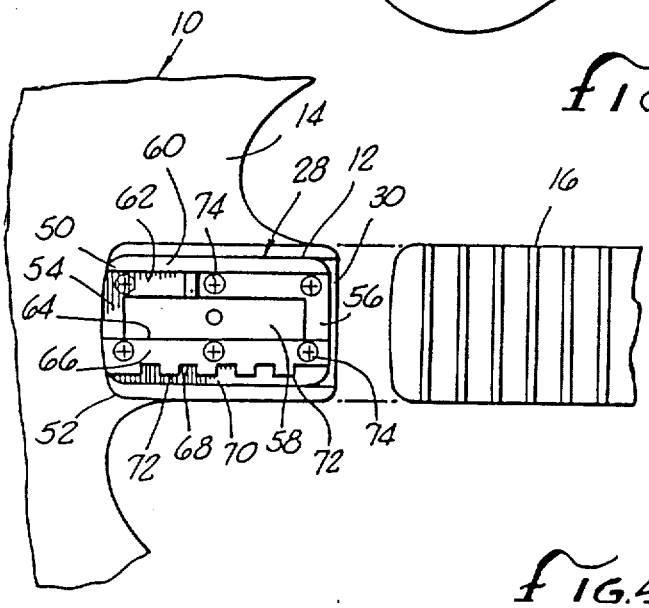
Figure 4:
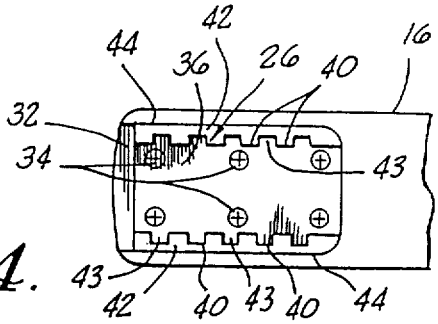
Figure 5:
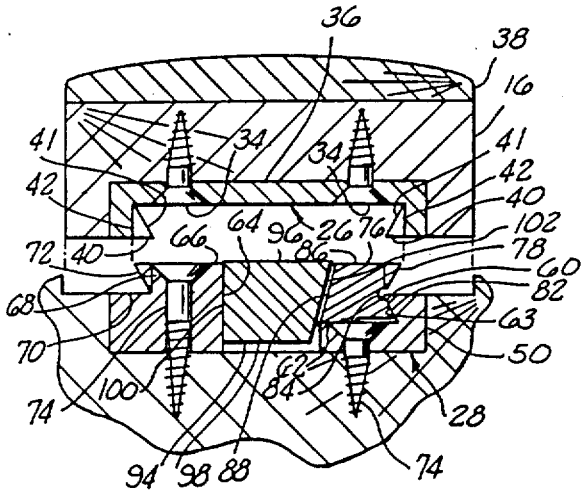
Figure 6:
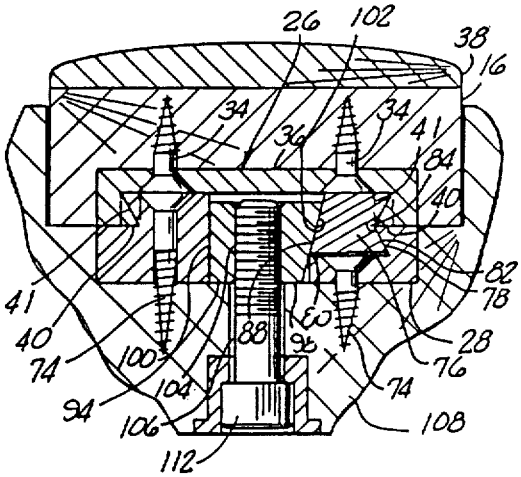
Figure 7:
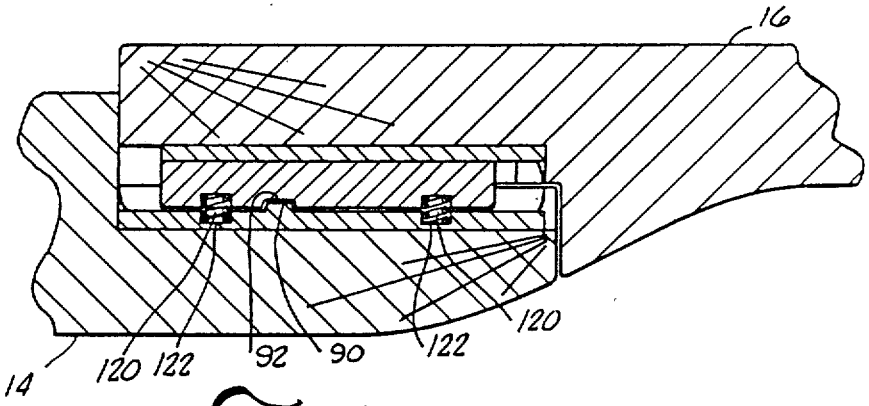
Figure 8:
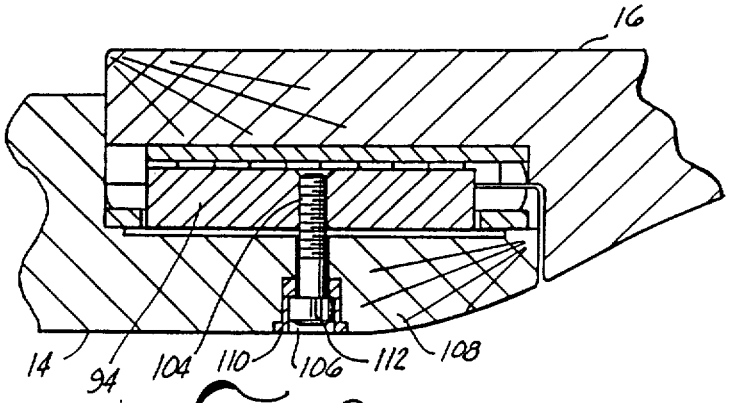

To facilitate use, one or two small coil springs 120 are provided in recesses 122 in the horizontal surface 62 which bear against the underside of register 76 to urge the register upwardly and thereby release the pressure exerted by the wedge lock member 94 upon loosening machine screw 112 as seen in FIG. 7. Additionally, it should be noted the longitudinally disposed recess 84 in register 76 is provided to prevent any binding of the register and allow the register to properly mate with and tighten against rail 60 even after wear has occurred.

Various changes and modifications may be made in carrying out the present invention without departing from the spirit and score thereof. Insofar as those changes and modifications falling within the purview of the appended claims, they are to be considered as part of the present invention.

We claim:

1. A self-aligning neck joint for releasably securing the neck of an electric guitar to the guitar body and maintaining the neck in fixed and proper alignment with the body, said joint comprising: a first bracket adapted to be rigidly secured to the neck of the guitar, said first bracket defining a pair of rows of spaced tooth members, said rows being disposed along the opposite lateral sides of said first bracket and each of said tooth members defining an inwardly inclined mating surface; a second bracket adapted to be rigidly secured to the body of the guitar such that upon said brackets being secured together the neck of the guitar is rigidly secured to and in proper alignment with the guitar body, said second bracket including a row of spaced rigid tooth members disposed along one side thereof, said tooth members defining inwardly inclined surfaces adapted to abut and mate with the inclined surfaces in one of said rows of tooth members on said first bracket, a horizontal support surface inclined locking surface disposed along the side of said second bracket opposite said second bracket tooth members and adjacent said horizontal support surface, a moveable elongated bar member defining a row of spaced rigid tooth members on one side thereof, said tooth members defining inwardly inclined surfaces adapted to abut and mate with the inclined surfaces on the tooth members in the other of said rows thereof on said first bracket, a first inclined surface disposed below said tooth members thereon and adapted to mate with said locking surface and a second inclined surface disposed on the opposite side of said bar member from said first inclined surface; a wedge locking member defining an inclined surface adapted to abut and mate with said second inclined surface on said bar member; and means for drawing said wedge lock member against said second inclined surface on said bar member such that said first inclined surface on said bar member is urged outwardly and against said locking surface and said inclined surfaces on said tooth members on said bar member are urged against said inclined surfaces of said tooth members in said other of said rows of tooth members on said first bracket thereby securing said second bracket to said first bracket and said neck to said body portion of the guitar in fixed and proper alignment with said body portion.

2. The combination of claim 1 including means for indexing said bar member on said horizontal surface such that said tooth members on said bar member are in alignment with said tooth members disposed along said one side of said bracket and said tooth members on s id first bracket.

3. The combination of claim 2 wherein said drawing means comprises a threaded screw member adapted to extend through a portion of the guitar neck and into and in threaded engagement with said wedge locking member such that upon rotating said screw member, said wedge locking member is urged toward the body of the guitar.

4. The combination of claim 3 including biasing means disposed between said horizontal surface on said second bracket and said bar member to urge said bar member from said horizontal surface.

* * * * *

UNITED STATES PATENT AND TRADEMARK OFFICE

CERTIFICATE OF CORRECTION

PATENT NO. : 4,793,236

DATED : December 27, 1988

INVENTOR(S) : McGuire, Michael D. and Boulanger, Stephen J.

It is certified that error appears in the above-identified patent and that said Letters Patent is hereby corrected as shown below:

Column 5, Line 26, should read as follows:

-- a horizontal support surface, an inclined locking surface --

Column 6, Line 22, should read as follows:

-- one side of said bracket and said tooth members on said --

Signed and Sealed this

Eleventh Day of July, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,793,236

DATED : December 27, 1988

INVENTOR(S) : Michael D. McGuire

It is certified that error appears in the above-identified patent and that said Letters Patent is hereby corrected as shown below:

The title page, showing the illustrative Figure, should be deleted to appear as shown on the attached title page.

"Delete sheets 1-2 of the drawings and substitute the new sheets 1-2 therefor."

Signed and Sealed this

Twenty-third Day of October, 1990

*Attest:*

HARRY F. MANBECK, JR.

*Attesting Officer*

*Commissioner of Patents and Trademarks*

United States Patent [19]

McGuire et al.

[11] Patent Number: 4,793,236

[45] Date of Patent: Dec. 27, 1988

[54] SELF-ALIGNING NECK JOINT

[75] Inventors: Michael D. McGuire, 9510 West Hierba, Agua Dulce, Calif. 91350; Stephen J. Boulanger, La Habra, Calif.

[73] Assignees: Albert J. Carness, Chatsworth; Michael D. McGuire, Northridge, both of Calif. ; part interest to each

[21] Appl. No.: 65,897

[22] Filed: Jun. 24, 1987

[51] Int. Cl.[4] ..... G10D 1/08

[52] U.S. Cl. ..... 84/293; 84/267

[58] Field of Search ..... 84/267, 291, 293

[56] References Cited

U.S. PATENT DOCUMENTS

| | | | |
|---|---|---|---|
| 463,953 | 11/1891 | Middlebrooke | 84/293 |
| 602,695 | 4/1898 | Casolin | 84/293 |
| 1,402,876 | 1/1922 | McHugh et al. | 84/293 |
| 2,497,116 | 2/1950 | Dopyera | 84/293 |
| 3,678,795 | 7/1972 | Fullerton | 84/293 |
| 4,027,570 | 6/1977 | Rendell et al. | 84/293 |
| 4,191,085 | 3/1980 | Litwin | 84/293 |
| 4,638,708 | 1/1987 | Kamal | 84/293 |

*Primary Examiner*—Lawrence R. Franklin

*Attorney, Agent, or Firm*—Lyon & Lyon

[57] ABSTRACT

A self-aligning neck joint for releasably securing the neck of an electric guitar to the guitar body and maintaining the neck in fixed proper alignment with the body. The neck joint includes a first bracket secured in a channel in the underside of the upper end of the neck and a second bracket secured in a neck pocket in the guitar body such that upon securing the brackets together the neck is secured to and fixed in proper alignment with the guitar body. The brackets each define a pair of rows of interlocking undercut teeth with one of the rows of teeth on the second bracket being moveable in a transverse direction for selective engagement and disengagement with the mating teeth on the first bracket to allow the brackets to be moved out of engagement and the neck separated from the guitar body. A moveable screw driven wedge is provided on the second bracket to urge the moveable teeth thereon outwardly into fixed engagement with the mating teeth on the first bracket and thereby tightly lock the neck to the body of the guitar in proper alignment.

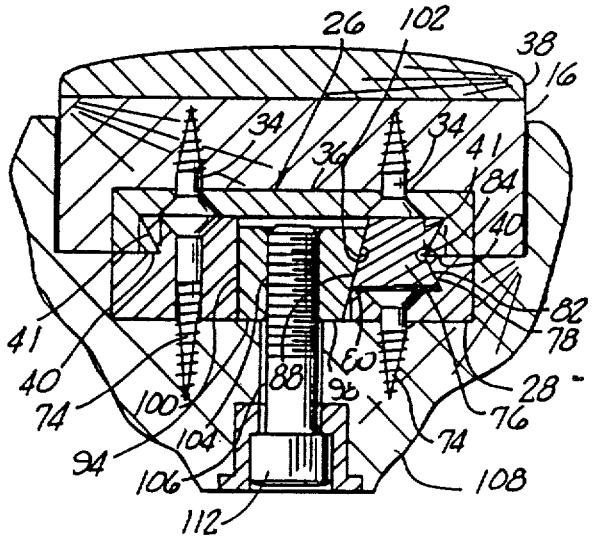

4 Claims, 2 Drawing Sheets